US005344520A

United States Patent [19]

Seki et al.

[11] Patent Number: 5,344,520

[45] Date of Patent: Sep. 6, 1994

[54] SINGLE-FACED CORRUGATED CARDBOARD SHEET MAKING MACHINE HAVING AN ADJUSTABLE PRESSING MEANS

[75] Inventors: Yukuharu Seki; Makoto Ando, both of Mihara, Japan

[73] Assignee: Mitsubishi Jukogyo Kabushiki Kaisha, Tokyo, Japan

[21] Appl. No.: 806,362

[22] Filed: Dec. 13, 1991

[30] Foreign Application Priority Data

Dec. 25, 1990 [JP] Japan ..... 2-405921

[51] Int. Cl.[5] ..... B31F 1/28

[52] U.S. Cl. ..... 156/472; 15/256.5; 100/153; 156/205; 156/210; 156/358

[58] Field of Search ..... 156/470, 471, 472, 210, 156/205, 358, 583.5; 100/153, 151; 425/373; 15/256.5

[56] References Cited

U.S. PATENT DOCUMENTS

| | | | |
|---|---|---|---|
| 124,048 | 2/1872 | Garfield | 100/153 X |
| 2,638,962 | 5/1953 | Nitchie | 156/473 |
| 2,793,674 | 5/1957 | Reinhard | 156/471 X |
| 3,516,889 | 6/1970 | Boynton et al. | 156/472 X |
| 3,527,638 | 9/1970 | Sonnichsen | 156/470 X |
| 4,177,725 | 12/1979 | Gersbeck | 100/153 X |
| 4,787,500 | 11/1988 | Holz | 15/256.5 |

FOREIGN PATENT DOCUMENTS

| | | | |
|---|---|---|---|
| 0024817 | 7/1980 | European Pat. Off. . | |
| 1252522 | 10/1967 | Fed. Rep. of Germany | 156/472 |
| 2527819 | 6/1975 | Fed. Rep. of Germany . | |
| 554064 | 5/1947 | France | 156/472 |
| 1220899 | 5/1960 | France | 156/471 |
| 2142591 | 6/1991 | France . | |
| 623280 | 7/1961 | Italy | 156/472 |
| 1442909 | 7/1976 | United Kingdom | 425/373 |

OTHER PUBLICATIONS

European Search Report dated Apr. 6, 1992.

*Primary Examiner*—Michael W. Ball
*Assistant Examiner*—Michele K. Yoder
*Attorney, Agent, or Firm*—Rothwell, Figg, Ernst & Kurz

[57] ABSTRACT

An improved single-faced corrugated cardboard sheet making machine is provided, in which at the time of sticking a core paper web and a liner to each other in a single-facer equipped corrugating machine, impacts and vibrations are not generated, and hence troubles such as breaking of paper webs do not occur. The improvement resides in that the known single-faced corrugated cardboard sheet making machine having a pair of corrugating rolls for corrugating a core paper web into a wave shape and a pasting member for applying paste to corrugation crest portions of the corrugated core paper web, is further provided with an endless belt for pressing and sticking a liner to the core paper web applied with paste. The pressing condition of the endless belt can be adjusted, and a device for cleaning the surface of the endless belt is also provided.

12 Claims, 9 Drawing Sheets

SINGLE-FACED CORRUGATED CARDBOARD SHEET MAKING MACHINE HAVING AN ADJUSTABLE PRESSING MEANS

BACKGROUND OF THE INVENTION

1. Field of the Invention

The present invention relates to a single-facer in a corrugating machine, and more particularly to a pasting mechanism between a core paper sheet and a liner therein.

2. Description of the Prior Art

A common corrugated cardboard sheet making machine (a single-facer) in the prior art is shown in FIGS. 12, 13 and 14, and a corrugated cardboard sheet making machine provided with a pressure member in the prior art is shown in FIGS. 15 and 16. A corrugated cardboard sheet making machine employing a belt pressing system is shown in FIG. 17.

A common single-facer in the prior art corrugating machine is composed of an upper roll 1, a lower roll 2 meshed with the upper roll 1 for shaping and a core paper web 4 into a corrugated shape (for corrugating a core paper web 4) as shown in FIGS. 12, 13 and 14, a pressure roll 3 for making a pasted core paper web 4 a liner 5 pass between the lower roll 2 and the pressure roll 3 while pressing them to stick them together and thereby making a single-faced corrugated cardboard sheet 6. A pasting roll 8 is provided; and for transferring and feeding paste 7 to crest portions of corrugations of the core paper web 4 that is shaped by being pinched between the upper and lower rolls 1 and 2, and the like.

Now, in the case of sticking the core paper web 4 to the liner 5 via the paste 7 transferred to the crest portions of the corrugations, essentially an appropriate pressing force and heating of the paste 7 are necessary. Thus in a single-faced corrugated cardboard sheet making machine are assembled an initial contact pressure adjusting device between the respective engaging rolls as well as a device capable of setting the rolls 1, 2 and 3 at a high temperature by introducing steam or oil into these rolls.

Next, brief description will be made on the structure of the upper roll 1 and the lower roll 2. In FIGS. 12, 13 and 14, a lower roll 2 is pivotably supported at a fixed position via bearings not shown, which are held as pinched by a frame 9 and a bracket 10. On the other hand, an upper roll 1 is pivotably supported by an arm 12 which can swing about fulcrum pins 11 via a bearing, and the other end of the same arm 12 is connected to a pressing cylinder 14 which is swingably mounted to the bracket 10 via a pin 13. Accordingly, if the pressing cylinder 14 is operated so as to extend and contract, it is possible to engage and disengage the upper and lower rolls 1 and 2 with and from each other, and also, provision is made such that a contact pressure between the respective rolls 1 and 2 can be arbitrarily adjusted by changing a hydraulic pressure in the cylinder 14. A method for supporting the pressing roll 3 from the frame 9 is similar to the method for supporting the upper roll 1, and provision is made such that a contact pressure between the lower roll 2 and the pressing roll 3 can be arbitrarily adjusted.

However, the above-described type of machine had the following disadvantages in connection to engagement between the lower roll 2 and the pressing roll 3. That is, as shown in FIG. 13, the teeth of the upper and lower corrugating rolls 1 and 2 in the prior art are straight teeth cut on the circumferential surface of the rolls in parallel to the roll axes, and under a meshed condition the teeth would be held in line contact with each other in parallel to the roll axes. Since the pressing roll 3 is a roll having a perfectly circular cross-section, at the engaging point with the lower corrugating roll 2, the engaging portions of the respective rolls 2 and 3 would take the states shown in FIG. 14. In this figure, solid lines depict the state where the pressing roll 3 is engaged with two teeth of the corrugating roll 2, while dash-dot lines depict the state where the pressing roll 3 is engaged with a crest portion of a single tooth of the corrugating roll 2. As described above, the engaged state of the respective rolls 2 and 3 would alternately repeat the engaged states depicted by solid lines and dash-dot lines according to a relative rotation between the rolls 2 and 3, respectively, and hence the center distance between these rolls 2 and 3 would always vary within the range of the maximum distance S shown in FIG. 14. From the above-mentioned reasons, vibrations and noises caused by the vibrations would be generated at the rolls 1, 2 and 3, and in an extreme case, for instance, in the case where raw paper web of poor quality is used, cutting (breaking) of the paper web would occur as a result of impacts and vibrations between the rolls. As a result of such bad working, degradation of quality such as mechanical strength of the produced corrugated cardboard sheet 6 was inevitable. In view of the aforementioned disadvantages, in recent years, machines of the types shown in FIGS. 15, 16 and 17 have been proposed.

The machine of the type shown in FIGS. 15 and 16 is a machine disclosed in the Official Gazette of Laid-Open Japanese Patent Specification No. 53-29893 (1978), in which in lieu of the pressing roll 3 in FIG. 12, there is provided a pressing member 20 positioned on the side opposed to the lower corrugating roll 2 via the raw paper webs (core paper web and liner web) and having a curved surface with a radius of curvature equal to or larger than the radius of the lower corrugating roll 2. In this structure, the gap clearance between the pressing member 20 and the lower corrugating roll 2 does not vary from an engaging point A up to an engaging point B shown in FIG. 16, and generation of vibrations and noises can be prevented. However, because of the fact that this pressing member 20 has a curved surface of a length longer than an intertooth distance l of the lower corrugating roll 2 and has its position fixed, in the course of traveling from the engaging point A up to the point B, a frictional force generated between the liner 5 and the pressing member 20 acts upon the liner 5. Accordingly, there is a shortcoming that a velocity difference is produced between the core paper web 4 forced to travel and the liner 5 subjected to a braking force, and hence peeling or poor sticking would occur.

Next, the machine of the type shown in FIG. 17 is a machine disclosed in the Official Gazette of Laid-Open Japanese Utility Model Specification No. 52-168769 (1977), in which the pressing member 20 in FIGS. 15 and 16 is omitted, and instead there are provided an endless belt 15 and an electromagnetic wave transmitter 21 disposed in the proximity of the inside or the outside of the endless belt 15 and capable of being set at a predetermined frequency. The electromagnetic wave transmitter 21 functions to apply an electric field to the lower corrugating roll 2 to enhance an adhesive force by gelling starch paste and also to dry the single-faced corrugated cardboard sheet 6 in the course of traveling. In other words, the corrugated cardboard sheet making machine of the belt-pressing type shown in FIG. 17 cannot apply a pressing force necessitated upon sticking the core paper web 4 and the liner 5 to each other in view of a property (a rupture resistance) of the belt 15, but it can provide the function of a single-facer only when it was assisted by the auxiliary function of the electromagnetic wave transmitter 21. Accordingly, although vibrations and noises which were shortcomings of the pressing-roll type could be eliminated, in the manufacture of a single-faced corrugated cardboard making machine, increased cost was inevitable.

In summary, the prior art described above involved the following problems to be resolved:

(1) The common corrugated cardboard sheet making machine in the prior art illustrated in FIGS. 12, 13 and 14 is of such type that at the time of sticking a core paper web formed in a wave-shape by means of upper and lower corrugating rolls to a liner via paste, a necessary pressing force is applied by a pressing roll held in contact with the corrugating roll via the core paper web and the liner, in which vibrations and noises would be generated by variations of a center distance between the corrugating roll and the pressing roll caused by changes of the relative phase between the respective rolls, that is, by the fact that the pressing roll alternately engages with the crest portion of the tooth of the corrugating roll and the middle portion (valley portion) between the teeth thereof. In addition, due to these vibrations, in the event that a core paper web of poor quality is used, there is a fear of breaking of the paper web, and so, degradation of quality of the product is inevitable.

(2) In the machine of the type shown in FIGS. 15 and 16, a difference in a traveling velocity is produced between the core paper web and the liner due to a slide resistance of the pressing member, hence there is a fear that peeling and imperfect sticking condition may be created, and it results in degradation of quality of the product (formation of unacceptable products).

(3) In addition, the machine of the type shown in FIG. 17 raises a manufacturing cost of a single-faced corrugated cardboard sheet making machine, jointly with a control apparatus, because it necessitates a special device such as an electromagnetic wave transmitter and the like.

SUMMARY OF THE INVENTION

It is therefore one object of the present invention to provide an improved single-faced corrugated cardboard sheet making machine, which is free from all the above-mentioned disadvantages of the machines in the prior art.

A more specific object of the present invention is to provide a single-faced corrugated cardboard sheet making machine, in which upon sticking a core paper web and a liner to each other, impacts nor vibrations are not generated, and hence troubles such as breaking of paper webs do not occur.

According to one feature of the present invention, there is provided a single-faced corrugated cardboard sheet making machine having a pair of corrugating rolls for corrugating a core paper web into a wave shape and a pasting member for applying paste to corrugation crest portions of the corrugated core paper web, which machine comprises an endless belt for pressing and sticking a liner to the core paper web applied with paste, and means for adjusting the pressing condition of the endless belt.

More particularly, a traveling endless belt is disposed contiguously to the outlet side of a pair of corrugating rolls for corrugating a core paper web. The core paper web corrugated by the corrugating rolls and a liner fed through another route are stuck together by press-pinching them between the endless belt and the corrugating roll on the outlet side. The endless belt is wound around a pair of rolls, and one of the rolls is made movable so that a tension of the belt and/or a wrapping angle of the belt around the corrugating roll can be adjustably varied. In addition, a cleaning mechanism for removing a refuse of paste adhered to the endless belt is provided.

Owing to the above-described structural feature, in operation of the single-faced corrugated cardboard sheet making machine according to the present invention, sticking of the core paper web and the liner is carried out by making the endless belt butt against the outlet side (the downstream side with respect to traveling of the core paper web) of the paired corrugating rolls. At that time, the necessary pressing force is obtained as a component force of a tension of the endless belt directed toward the center axis of the corrugating roll held in contact with the endless belt. At the time of forming a single-faced corrugated cardboard sheet, there is a correlation between the pressing force and the pressing time, that is, if the pressing force is increased, then shortening of the pressing time can be achieved, and on the contrary, if the pressing time is extended, then the pressing force can be reduced. The pressing force can be controlled by making the tension of the belt adjustable. Also, control of the pressing time is made possible by making the wrapping angle of the belt around the corrugating roll variable. Furthermore, by providing a scraper held in contact with the belt and made slidable in the widthwise direction thereof, refuse of paste adhered to the surface of the belt and solidified can be removed, and thereby scratches and contamination which may occur on the surface of the sheet coming into contact with the endless belt, can be reduced.

The above-mentioned and other objects, features and advantages of the present invention will become more apparent by reference to the following description of preferred embodiments of the invention taken in conjunction with the accompanying drawings.

DESCRIPTION OF THE PREFERRED EMBODIMENTS

Figure 1:
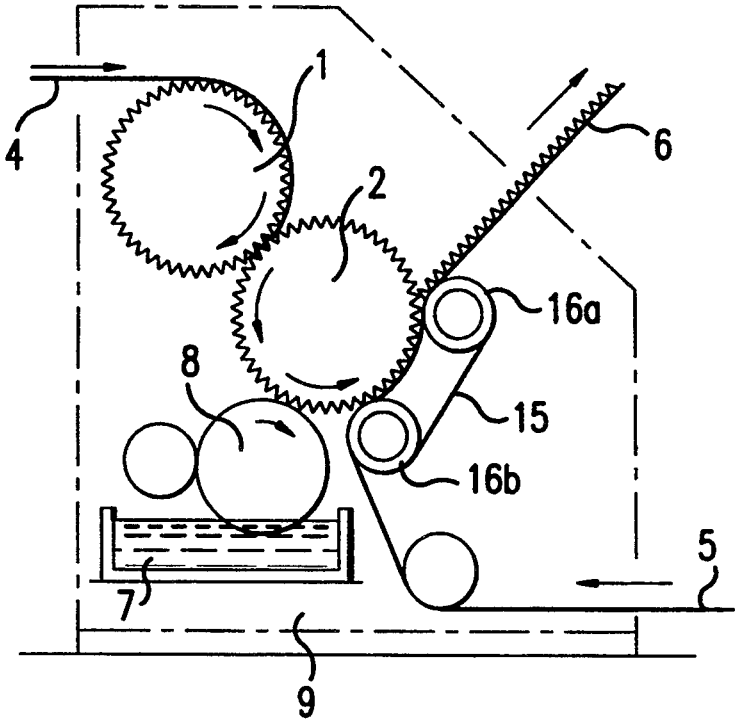
FIG. 1 is a general front view of one preferred embodiment of the present invention.

In the following, description will be made of a number of preferred embodiments of the present invention with reference to the accompanying drawings.

In FIGS. 1 to 11, reference numeral 1 designates an upper corrugating roll, numeral 2 designates a lower corrugating roll, numeral 4 designates a core paper web, numeral 5 designates a liner, numeral 6 designates a single-faced corrugated cardboard sheet, numeral 7 designates paste, numeral 8 designates a pasting roll, numeral 9 designates a frame, numeral 15 designates an endless belt, numeral 16 designates rolls, numeral 17 designates a cylinder (roll moving means), numeral 18 designates a scraper, and numeral 19 designates a deviation detection sensor, Reference character F represents a tension of the endless belt, reference character P represents a pressing force of the endless belt against a corrugating roll and reference character $\theta$ represents a wrapping angle of the endless belt around the corrugating roll.

Figure 2:
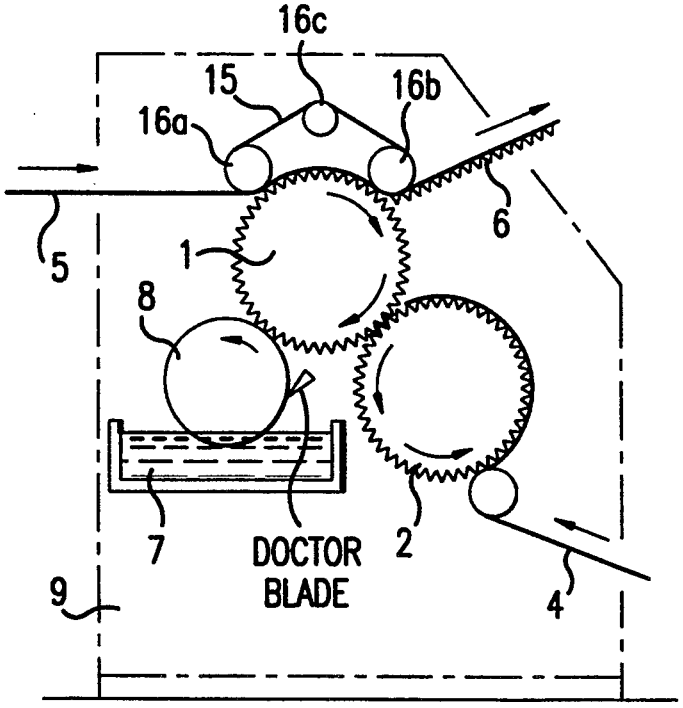
FIG. 2 is a general front view of another preferred embodiment of the present invention.
Figure 3:
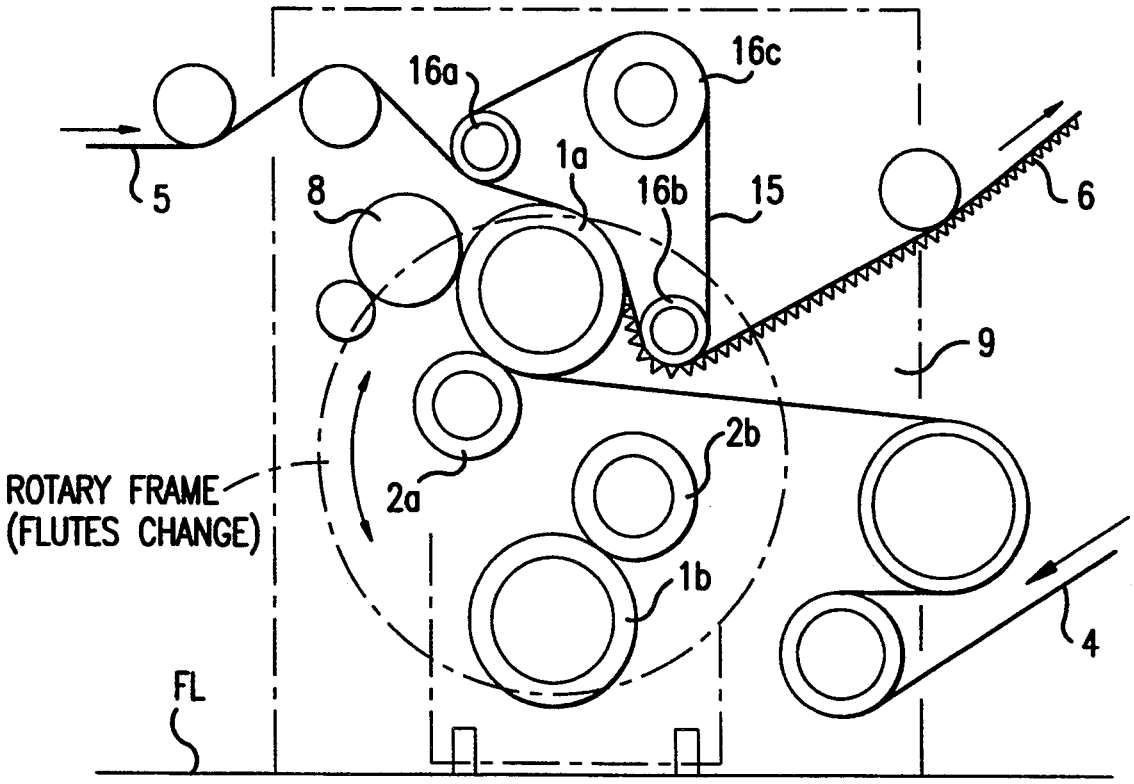
FIG. 3 is a general front view of still another preferred embodiment of the present invention.

FIGS. 1 to 3, respectively, are general front views of different preferred embodiments of the present invention. In the embodiments shown in FIGS. 1 and 2, respectively, the endless belt 15 is disposed along the circumference of the lower corrugating roll 2 or the upper corrugating roll 1 so as to press-pinch a corrugated core paper web 4 and a liner 5 therebetween, whereas in the embodiment shown in FIG. 3, the endless belt is disposed along the circumference of the upper corrugating roll 1*a* on the outlet side, and two sets of upper and lower corrugating rolls 1*a*, 2*a*; 1*b*, 2*b* are mounted on a rotary frame 20 to make the flutes variable.

FIGS. 4 to 11 are illustrations for explaining the construction and function of the first preferred embodiment shown in FIG. 1. After paste 7 has been applied to the corrugation crest portions of the core paper web 4 corrugated into a wave shape by passing through the gap space between the mutually meshed upper and lower corrugating rolls 1 and 2, the core paper web 4 is made to join with a liner 5 fed through another route, and by applying a predetermined pressing force, a single-faced corrugated cardboard sheet 6 is formed. As pressing means necessitated for sticking the two sheets (a core paper web and a liner) together, in lieu of the pressing roll 3 in FIG. 12, a part of an endless belt 15 is held in contact with the sheets and a pressing force is applied by means of only a tension of the belt.

Figure 4:
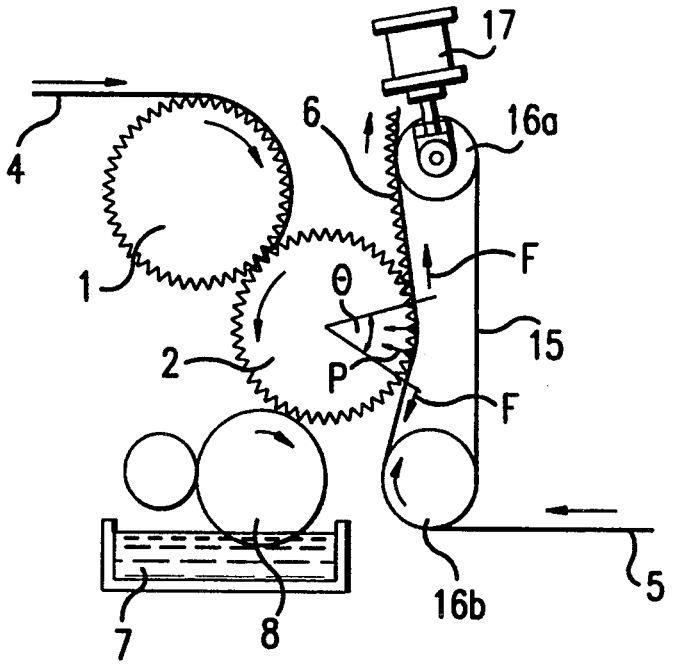
FIG. 4 is a front view of a tension adjusting mechanism for the endless belt shown in FIG. 1.

In the following, description will be made on the constructions and functions of the respective component parts In the construction shown in FIG. 4 one roll 16*a* among the rolls 16 having the endless belt 15 wrapped therearound is made movable nearly in the vertical direction (in the direction connecting the centers of the rolls 16*a* and 16*b*), a tension F of the endless belt 15 is controlled by adjusting a hydraulic pressure (a pneumatic pressure) or the like applied to a cylinder 17 so that a predetermined pressing force P may be generated between the endless belt 15 and the lower corrugating roll 2 held in contact with the belt.

Figure 5:
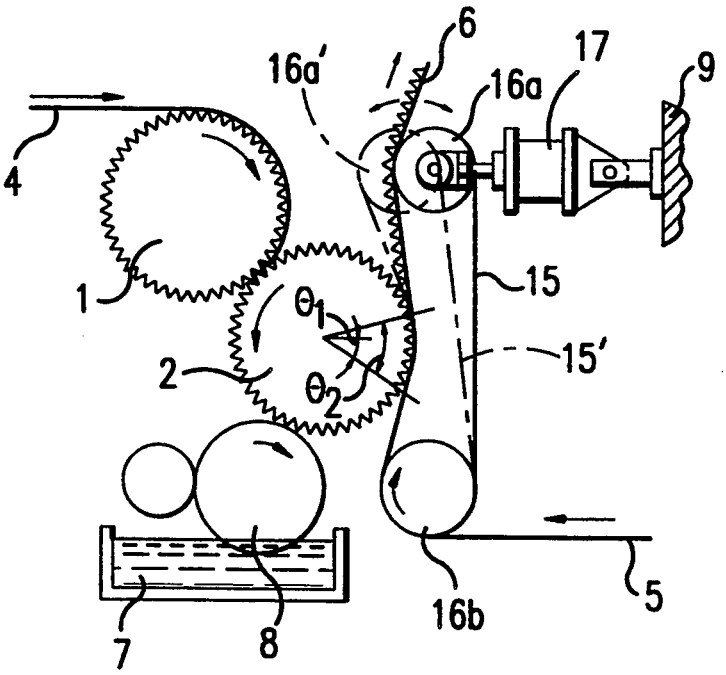
FIG. 5 is a front view of a wrapping angle adjusting mechanism for the endless belt shown in FIG. 1.
Figure 6:
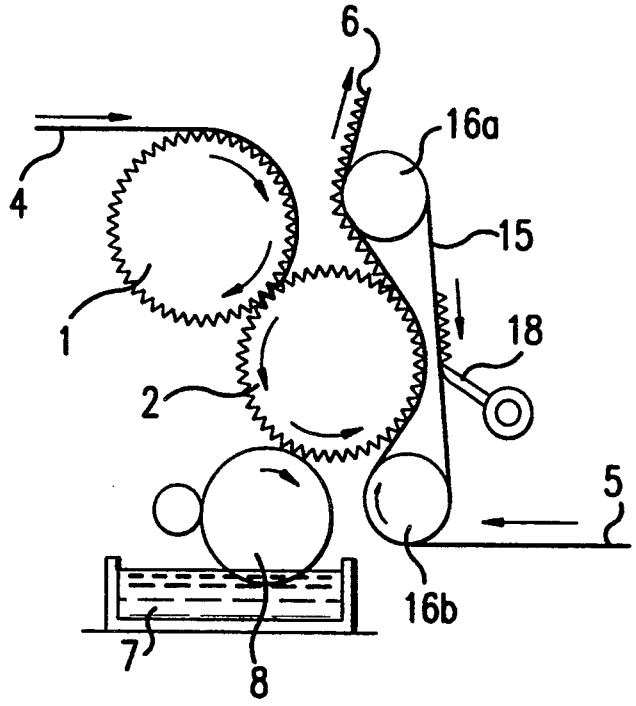
FIG. 6 is a front view of a belt surface cleaning scraper for the endless belt shown in FIG. 1.

In the construction shown in FIG. 5, one roll 16*a* among the rolls 16 having the endless belt 15 wrapped therearound is made movable in the horizontal direction (in the direction nearly at right angles to the direction connecting the centers of the rolls 16*a* and 16*b*) via a cylinder 17, thus the relative positioning between the rolls 16*a* and 16*b* and the lower corrugating roll 2 is made variable so that a wrapping angle e of the endless belt 15 around the above-mentioned corrugating roll 2 can be adjusted.

Now, in the case of sticking the corrugated core paper web 4 with a liner 5 via paste 7, predetermined temperature, pressing force and pressing time are required. Between the pressing force and the pressing time involved in this necessary condition for a sticking operation, there exists a correlation. That is, if the above-mentioned pressing force P is increased, the pressing time can be shortened, while if the pressing time is extended, the pressing force P (the belt tension F) can be reduced. Under the above-mentioned correlative condition, the apparatus shown in FIG. 4 is operated so that an ideal sticking condition can be realized by varying the pressing force P (the belt tension F), and the apparatus shown in FIG. 5 is operated so that an ideal sticking condition can be realized by varying the pressing time (the angular extension $\theta$ of the contact portion). By appropriately combining these operations, it is possible to establish the most ideal sticking condition under various sheet orders such as a specification of the raw paper sheets (a core paper web 4 and a liner 5), a manufacturing speed of a single-faced corrugated cardboard sheet 6, and the like.

FIGS. 6 to 11 illustrate measures for resolving problems arising in connection to the belt pressing system. In the apparatus shown in FIG. 6, a scraper 18 capable of coming into contact with and separating from the endless belt 15 over the enter region in the widthwise direction, is brought into slide contact with the endless belt 15. When the paste 7 at the corrugation crest portions of the core paper web 4 and/or paper powder has adhered to the surface of the belt 15 in the case where the width of the liner 5 is narrow with respect to the width of the core paper web 4 or due to the fact that the core paper web 4 and the liner 5 relatively deviate in position in the widthwise direction, these paste and/or paper powder are scraped out by the scraper 18, and thereby the belt surface can be cleaned. The paste 7 transferred from the end of the width of the core paper web 4 to the side of the belt 15 would cause scattering paper powder to adhere to the surface of the belt 15, and as time elapses, it secures to and accumulates on the surface of the belt 15. Thus it becomes a direct cause of remarkable degradation of quality of the products such as scratching the surface of the single-faced corrugated cardboard sheet 6 or applying contaminations to the surface coming into contact therewith.

Figure 7:
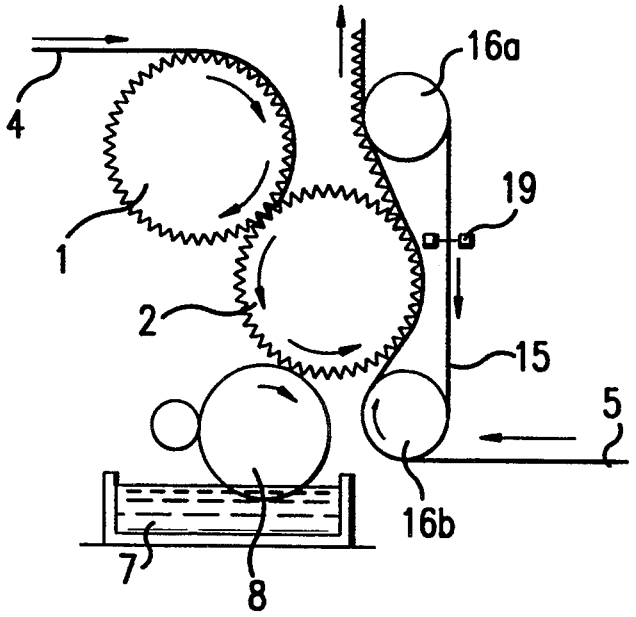
FIG. 7 is a front view of a deviation detection sensor for the endless belt shown in FIG. 1.
Figure 8:
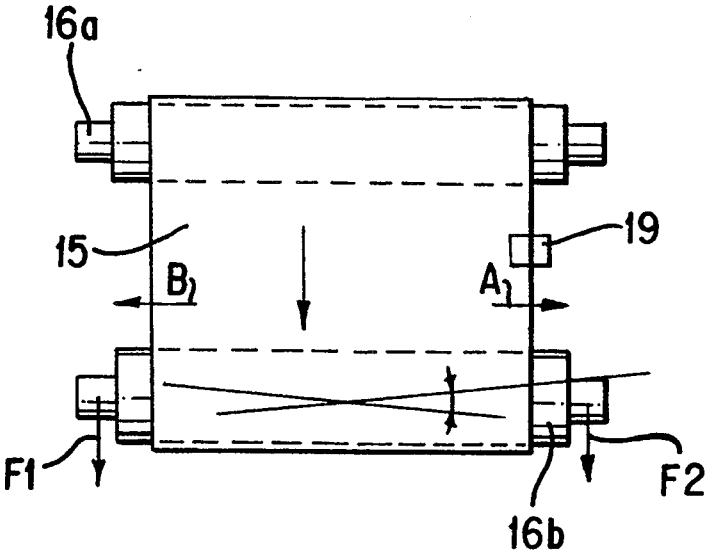
FIG. 8 is a side view of the sensor shown in FIG. 7.

In the apparatus shown in FIGS. 7 and 8, construction is made such that the opposite axial end portions of the rolls 16 having an endless belt 15 wrapped therearound can be relatively moved, thus tensions F applied to the opposite end portions of the width of the belt 15 are made variable so that a traveling belt 15 can be moved in the widthwise direction, and thereby the traveling position of the belt 15 can be corrected and zig-zag traveling of the belt 15 can be prevented. More particularly, in the event that the belt 15 has moved in the direction of arrow A in FIG. 8, the tension $F_2$ in this figure is enhanced with respect to the tension $F_1$, resulting in $F_2>F_1$, whereas in the event that the belt 15 has moved in the direction of arrow B in FIG. 8, on the contrary, the condition of $F_1>F_2$ is established. (Normally, an endless belt wrapped around straight rolls not provided with a crown, would displace towards the side where a tension is relatively weak as it rotationally travels.) It is to be noted that if the deviation of the belt in the widthwise direction is detected by a widthwise end detector (for instance, a transparent type photocell sensor disposed in opposition to the belt 15) 19 and the detection signal is fed back to means for moving the shaft not shown, then the deviation of the belt 15 can be automatically corrected.

Figure 9:
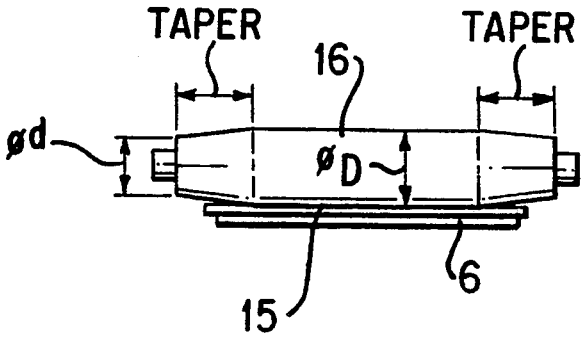
FIG. 9 is a plan view of a roll for use with the endless belt, which roll is provided with tapered portions at its opposite ends.

In the structure shown in FIG. 9, at the opposite end portions of the rolls 16 having the endless belt 15 wrapped therearound, a taper is formed such that a diameter $\phi_d$ of the end may become smaller than a diameter $\phi_D$ of the central portion, and this structure serves to reduce the tension at the widthwise end portion of the belt 15 where cracks are liable to occur due to a high tension and thus preventing the belt 15 from breaking at the cracks. Since a very high belt tension F is required in order to obtain an appropriate pressing force P against the corrugating roll 1 or 2 via the single-faced corrugated cardboard sheet 6, the structure of the roll end portions shown in FIG. 9 is employed as countermeasures for dealing with the anxious breaking of the belt.

Figure 10A:
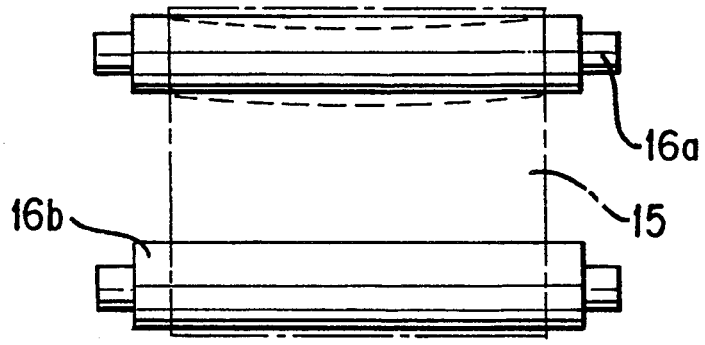
FIGS. 10A–10B are a side view and a tension distribution diagram for straight type rolls to be used with the endless belt.
Figure 10B:
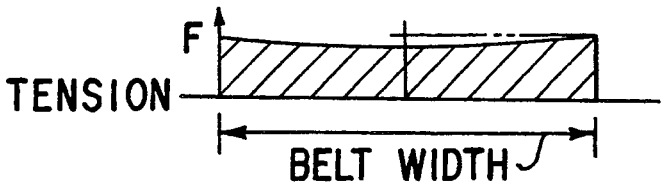
Figure 11A:
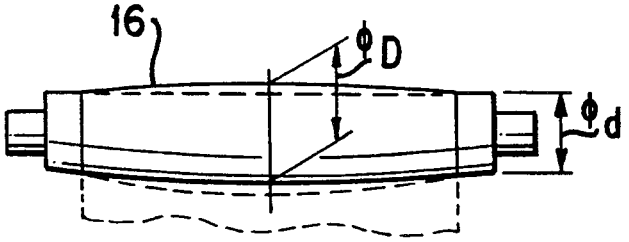
FIGS. 11A–11B are a side view and a tension distribution diagram for crown type rolls to be used with the endless belt.
Figure 11B:
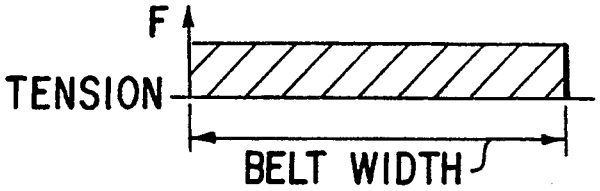
Figure 12:
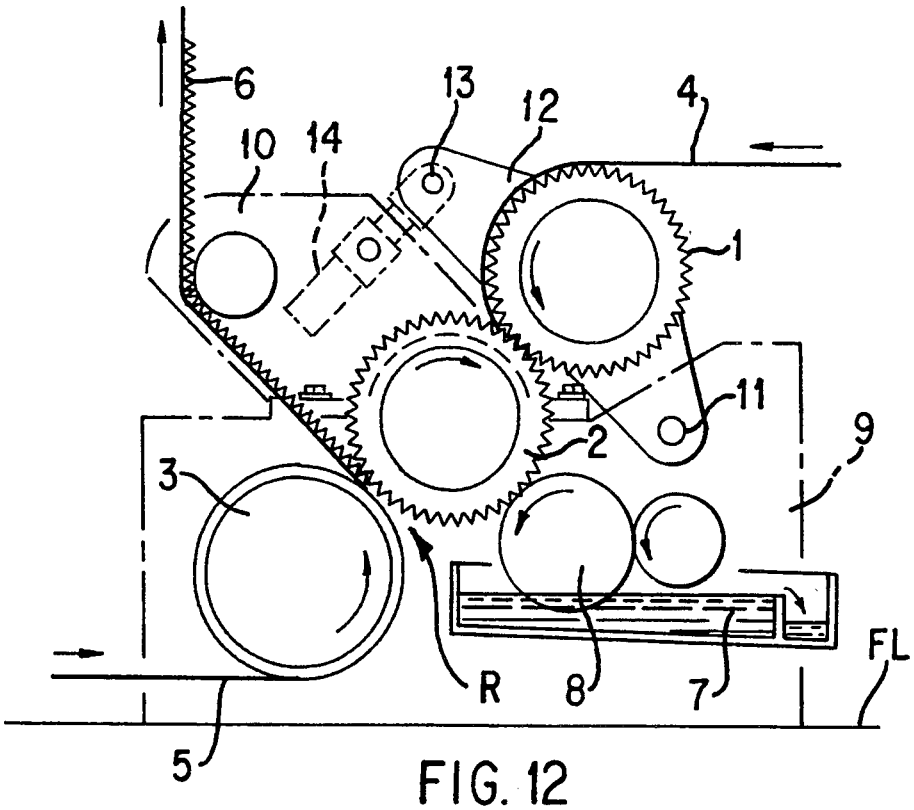
FIG. 12 (PRIOR ART)
FIG. 12 is a schematic front view of a common corrugated cardboard sheet making machine in the prior art.
Figure 13:
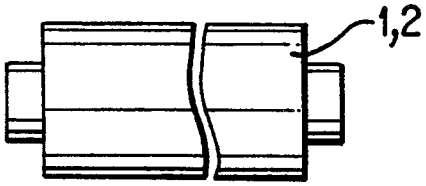
FIG. 13 (PRIOR ART)
FIG. 13 is a schematic side view of a corrugating roll shown in FIG. 12.
Figure 14:
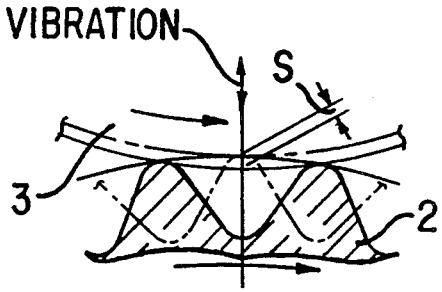
FIG. 14 (PRIOR ART)
FIG. 14 is an enlarged partial view showing details of the portion indicated by arrow R in FIG. 12.

In the structure shown in FIG. 11A, the outer circumferential surface of the rolls 16 having the endless belt 15 wrapped therearound is formed in a crown shape (drum shape) in which a diameter $\phi_D$ at the central portion is larger than a diameter $\phi_d$ at the end portions, and this serves to prevent the tension in the belt from varying (distributing) along the widthwise direction of the belt due to bending of the rolls 16. More particularly, in the case of the common straight type roll as shown in FIGS. 10A–10B, the central portion of the roll deforms as depicted by dash lines due to bending load applied to the roll 16 by the belt tension, and so, there is a tendency that a tension F at the widthwise central portion of the belt 15 is reduced. However, in the case of a crown shaped roll shown in FIGS. 11A–11B, as a result of bending deformation at the time when a predetermined tension is applied to the belt 15, the tension in the belt 15 becomes uniform along the widthwise direction of the belt 15.

The second and third preferred embodiments of the present invention shown in FIGS. 2 and 3, respectively, also have similar constructions to the first preferred embodiment shown in FIG. 1 and described above, and so, they have the same functions, operations and advantages as the first preferred embodiment.

Figure 15:
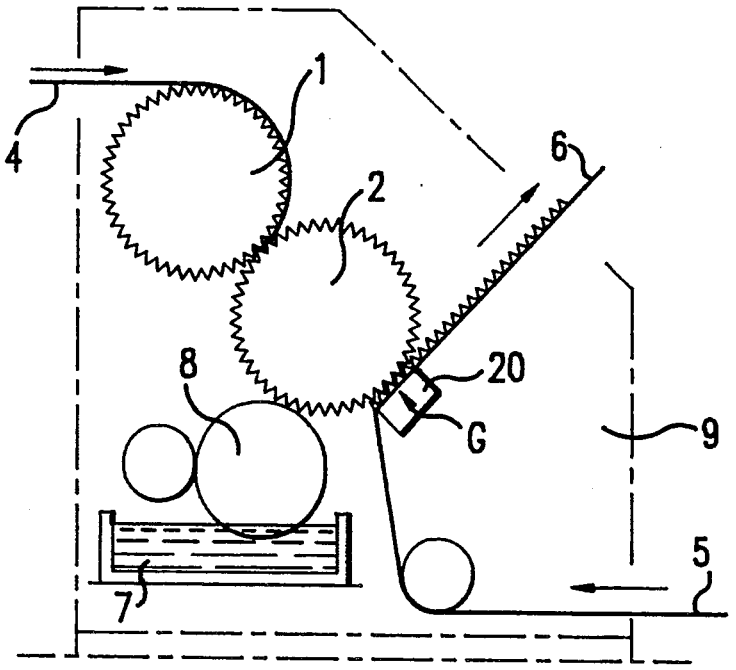
FIG. 15 (PRIOR ART)
FIG. 15 is a schematic front view of a corrugated cardboard sheet making machine provided with a pressing member in the prior art.
Figure 16:
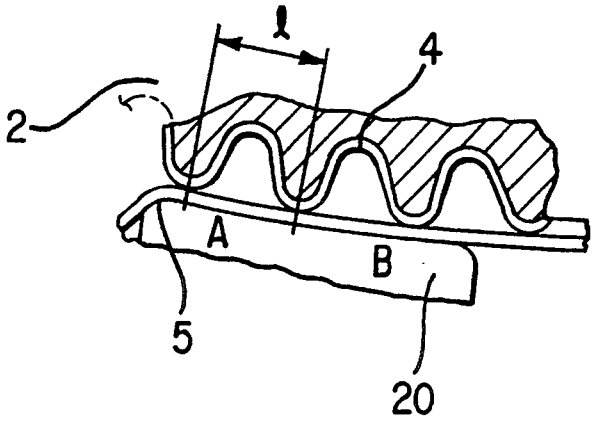
FIG. 16 (PRIOR ART)
FIG. 16 is an enlarged partial view showing details of the portion indicated by arrow G in FIG. 15.

Since the present invention has the above-described structural features, as compared to the belt pressing system in the prior art, the present invention offers the following advantages. That is, owing to the fact that a pressure member disposed in opposition to a corrugating roll via a core paper web and a liner as shown in FIG. 15 is not provided, a frictional force serving to brake the liner is not generated, hence the disadvantage of occurrence of peeling off between the core paper web and the liner is eliminated, and in addition, the tendency of generating warping deformation of a manufactured single-faced corrugated cardboard sheet caused by the same reason is also reduced.

Figure 17:
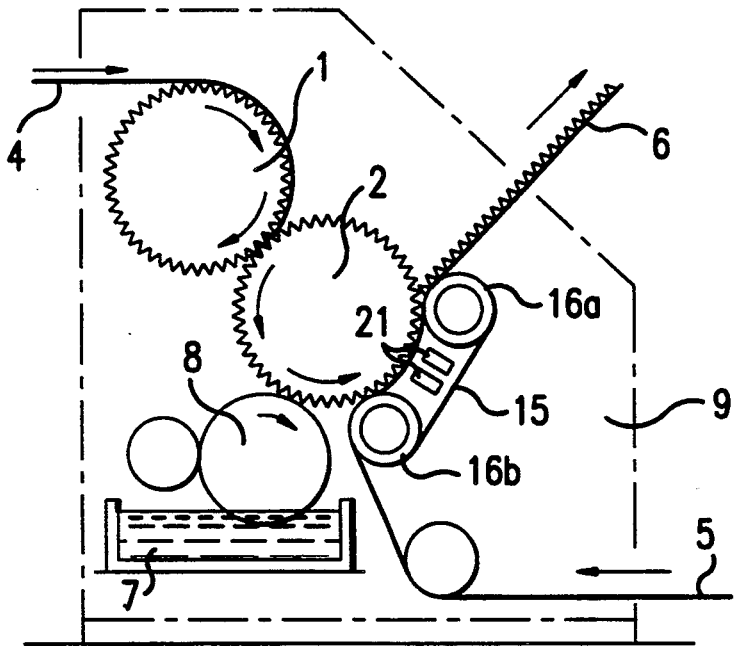
FIG.17 PRIOR ART
FIG. 17 is a schematic front view of a corrugated cardboard sheet making machine provided with an electromagnetic wave transmitter in the prior art.

Moreover, while an electromagnetic wave transmitter acting upon the pressing surface of the belt is provided for the purpose of increasing an adhesive force of paste in the belt-pressing system shown in FIG. 17, according to the present invention, since such transmitter is made unnecessary, reduction of a manufacturing cost of a corrugated cardboard sheet making machine as well as various expenses for maintenance, inspection and repair of the machine, can be achieved. Besides, since improved means for various problems which may arise as a result of employment of an endless belt, is associated with the machine, not only a pressing force but also a uniform pressing force distribution and various other functions can be improved. Thereby, improvements of quality of corrugated cardboard sheets, enhancement of a productivity, and reduction of a failure rate of the apparatus can be realized.

In summary, the single-faced corrugated cardboard sheet making machine has the following advantages, owing to the fact that in a single-faced corrugated cardboard sheet making machine having a pair of corrugating rolls for corrugating a core paper wave into a wave shape, and a pasting member for applying paste to corrugation crest portions of the corrugated core paper web, there are provided an endless belt for pressing and sticking a liner to the core paper web applied with paste, and means for adjusting the pressing condition of the endless belt, and furthermore, there is provided means for cleaning the surface of the belt:

(a) A pressing force necessitated upon sticking a core paper web to a liner is obtained by only a contact pressure resulted from a tension of an endless belt.
(b) The disadvantages of the machine in the prior art which employs a pressing roll as pressing means, that is, generation of impacts, vibrations and noises between rolls (corrugating rolls and a pressing roll) can be eliminated.
(c) Various troubles such as breaking of a paper web and the like generated due to the disadvantages enumerated in paragraph (b) above, can be obviated.
(d) Since the most appropriate pressing force and pressing time corresponding to a specification of sheets (paper sheet thickness and the like) and a manufacturing speed can be preset, wasted paper sheets caused by failure can be eliminated, and improvements in quality of corrugated cardboard sheets as well as enhancement of a productivity can be achieved.

While a principle of the present invention has been described above in connection to preferred embodiments of the invention, it is intended that all matter contained in the above description and illustrated in the accompanying drawings shall be interpreted to be illustrative and not in a limiting sense.

What is claimed is:

1. A single-faced corrugated cardboard sheet making machine having a pair of corrugating rolls for corrugating a core paper web into a wave shape, and a pasting member for applying paste to corrugation crest portions of the corrugated core paper web; the machine having an endless belt for pressing and sticking a liner to the core paper web applied with paste, and means for adjusting the pressing condition of the endless belt, with improvements comprising; means for cleaning the surface of the endless belt, and the means for adjusting the pressing condition of the endless belt including the belt being trained around the circumference of at least two belt rolls which press the endless belt against the liner on the surface of the corrugating roll, and wherein one of the rolls around which the endless belt is trained is movable to adjust the pressing condition, the movement being substantially in the direction of a line connecting the center of the rolls carrying the endless belt.

2. A single-faced corrugated cardboard sheet making machine having a pair of corrugating rolls for corrugating a core paper web into a wave shape, and a pasting member for applying paste to corrugation crest portions of the corrugated core paper web; the machine having an endless belt for pressing and sticking a liner to the core paper web applied with paste, and means for adjusting the pressing condition of the endless belt, with improvements comprising: means for cleaning the surface of the endless belt, and the means for adjusting the pressing condition of the endless belt including the belt being trained around the circumference of at least two belt rolls which press the endless belt against the liner on the surface of the corrugating roll, and wherein one of the rolls around which the endless belt is trained is movable in an adjustable manner with respect to the other roll to accomplish adjusting the pressing condition, the movement being in the direction at substantially right angles to the direction of a line connecting the centers of the rolls carrying the endless belt.

3. A single-faced corrugated cardboard sheet making machine having a pair of corrugating rolls for corrugating a core paper web into a wave shape, and a pasting member for applying paste to corrugation crest portions of the corrugated core paper web; the machine having an endless belt for pressing and sticking a liner to the core paper web applied with paste, and means for adjusting the pressing condition of the endless belt, with improvements comprising: means for cleaning the surface of the endless belt, and the means for adjusting the pressing condition of the endless belt including the belt being trained around the circumference of at least two belt rolls which press the endless belt against the liner on the surface of the corrugating roll, and wherein one of the rolls around which the endless belt is trained is movable to adjust the pressing condition, the movement being substantially in the direction of a line connecting the centers of the rolls carrying the endless belt; and said machine being provided with a belt travel direction correcting means for correcting deviation of the endless belt from a straight path of travel around the belt carrying rolls and for controllably relatively displacing a shaft carrying at least one of the rolls to automatically correct any deviation of the belt.

4. A single-faced corrugated cardboard sheet making machine having a pair of corrugating rolls for corrugating a core paper web into a wave shape, and a pasting member for applying paste to corrugation crest portions of the corrugated core paper web; the machine having an endless belt for pressing and sticking a liner to the core paper web applied with paste, and means for adjusting the pressing condition of the endless belt, with improvements comprising: means for cleaning the surface of the endless belt, and the means for adjusting the pressing condition of the endless belt including the belt being trained around the circumference of at least two belt rolls which press the endless belt against the liner on the surface of the corrugating roll, and wherein one of the rolls around which the endless belt is trained is movable to accomplish adjusting the pressing condition, the movement being in the direction at substantially right angles to the direction of a line connecting the centers of the rolls carrying the endless belt; and said machine being provided with a belt travel direction correcting means for correcting deviation of the endless belt from a straight path of travel around the belt carrying rolls and for controllably relatively displacing a shaft carrying at least one of the rolls to automatically correct any deviation of the belt.

5. A single-faced corrugated cardboard sheet making machine as claimed in claim 2, wherein said machine is provided with a belt travel direction correcting means for correcting deviation of the endless belt from a straight path of travel around the belt carrying rolls and for controllably relatively displacing a shaft carrying at least one of the rolls to automatically correct any deviation of the belt.

6. A single-faced corrugated cardboard sheet making machine as claimed in claims 1 or 2, wherein the outer circumferential surfaces of the rolls having said endless belt wound therearound are formed in a crown shape.

7. A single-faced corrugated cardboard sheet making machine as in claim 3, wherein the outer circumferential surfaces of the rolls having said endless belt wound therearound are formed in a crown shape.

8. A single-faced corrugated cardboard sheet making machine as in claim 4, wherein the outer circumferential surfaces of the rolls having said endless wound therearound are formed in a crown shape.

9. A single-faced corrugated cardboard sheet making machine as in claim 3, wherein said means for adjusting the pressing condition of the endless belt is for moving one of the rolls linearly away from or toward the other roll to adjust the tension in the belt.

10. A single-faced corrugated cardboard sheet making machine as in claim 4, wherein said means for adjusting the pressing condition of the endless belt by moving one of the rolls in an adjustable manner with respect to the other roll, in the direction at substantially right angles to the direction of a line connecting the centers of the rolls carrying the endless belt, is for selectively varying the amount of the belt surface which is wrapped around the corrugated roll with the liner therebetween.

11. A single-faced corrugated cardboard sheet making machine as in claim 1, wherein said means for adjusting the pressing condition of the endless belt is for moving one of the rolls linearly away from or toward the other roll to adjust the tension in the belt.

12. A single-faced corrugated cardboard sheet making machine as in claim 2, wherein said means for adjusting the pressing condition of the endless belt by moving one of the rolls in an adjustable manner with respect to the other roll, in the direction at substantially right angles to the direction of a line connecting the centers of the rolls carrying the endless belt, is for selectively varying the amount of the belt surface which is wrapped around the corrugated roll with the liner therebetween.

* * * * *

UNITED STATES PATENT AND TRADEMARK OFFICE

CERTIFICATE OF CORRECTION

PATENT NO. : 5,344,520

DATED : September 6, 1994

INVENTOR(S) : Yukuharu Seki et al.

It is certified that error appears in the above-identified patent and that said Letters Patent is hereby corrected as shown below:

Col. 5, line 40, "sensor," should be --sensor.--.

Col. 6, line 8, "parts" should be --parts.--.

Col. 6, line 25, "e" should be --θ--.

Col. 10, line 37, after "endless" insert --belt--.

Signed and Sealed this

Fourth Day of April, 1995

Bruce Lehman

*Attest:*

BRUCE LEHMAN

*Attesting Officer*

*Commissioner of Patents and Trademarks*